US009009996B2

(12) United States Patent
Amada et al.

(10) Patent No.: US 9,009,996 B2
(45) Date of Patent: Apr. 21, 2015

(54) EXCAVATING TOOTH AND BODY FOR EXCAVATING TOOTH

(71) Applicant: Komatsu Ltd., Tokyo (JP)

(72) Inventors: Eiji Amada, Kyotanabe (JP); Takanori Nagata, Dallas, TX (US); Kenichi Tanaka, Hirakata (JP); Daijirou Itou, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/128,772

(22) PCT Filed: Jan. 29, 2013

(86) PCT No.: PCT/JP2013/051854

§ 371 (c)(1),
(2) Date: Dec. 23, 2013

(87) PCT Pub. No.: WO2014/057693

PCT Pub. Date: Apr. 17, 2014

(65) Prior Publication Data

US 2014/0215867 A1 Aug. 7, 2014

(30) Foreign Application Priority Data

Oct. 10, 2012 (JP) ..... 2012-224943

(51) Int. Cl.
*E02F 9/28* (2006.01)

(52) U.S. Cl.
CPC ..... *E02F 9/2858* (2013.01); *E02F 9/285* (2013.01); *E02F 9/2833* (2013.01)

(58) Field of Classification Search
USPC ..... 37/446.45–446.46, 270; 172/701.1–701.3, 702–704, 747, 781
See application file for complete search history.

(56) References Cited

U.S. PATENT DOCUMENTS

| | | | | | |
|---|---|---|---|---|---|
| 3,790,353 | A | * | 2/1974 | Jackson et al. | 75/236 |
| 4,903,420 | A | | 2/1990 | Kreitzberg et al. | |
| 5,081,774 | A | * | 1/1992 | Kuwano | 37/460 |
| 5,111,600 | A | * | 5/1992 | Lukavich et al. | 37/452 |
| 5,337,801 | A | * | 8/1994 | Materkowski | 164/98 |
| 5,502,905 | A | * | 4/1996 | Cornelius et al. | 37/460 |
| 5,778,572 | A | * | 7/1998 | Lukavich et al. | 37/460 |
| 6,047,487 | A | | 4/2000 | Clendenning | |

(Continued)

FOREIGN PATENT DOCUMENTS

| | | | |
|---|---|---|---|
| CN | 1015722 | B | 3/1992 |
| CN | 1182304 | C | 12/2004 |
| CN | 102535577 | A | 7/2012 |
| JP | S46-8663 | | 3/1971 |
| JP | 2004-092208 | A | 3/2004 |

(Continued)

*Primary Examiner* — Robert Pezzuto
(74) *Attorney, Agent, or Firm* — Drinker Biddle & Reath LLP

(57) ABSTRACT

An excavating tooth includes a body and an abrasion-resistant layer. The abrasion-resistant layer has hardness higher than the body. The body includes a tip end face, a first face, a second face, a pair of first slope faces, and a pair of second slope faces. The abrasion-resistant layer includes a first abrasion-resistant layer section and a second abrasion-resistant layer section. The first abrasion-resistant layer section is formed on the tip end face. The second abrasion-resistant layer section is formed respectively on the pair of first slope faces and the pair of second slope faces. Thereby, it is possible to obtain an excavating tooth and a body for the excavating tooth capable of keeping a penetration force of a blade edge high in penetrating into an excavation subject.

6 Claims, 9 Drawing Sheets

(56) References Cited

U.S. PATENT DOCUMENTS

| | | | | |
|---|---|---|---|---|
| 6,571,493 | B2 * | 6/2003 | Amano et al. | 37/460 |
| 7,874,085 | B1 * | 1/2011 | Winter et al. | 37/270 |
| 8,646,192 | B2 * | 2/2014 | Berton | 37/460 |
| 8,806,785 | B2 * | 8/2014 | Brufau Guinovart et al. | 37/460 |

FOREIGN PATENT DOCUMENTS

| | | | |
|---|---|---|---|
| JP | 2004-183416 | A | 7/2004 |
| JP | 2004-218417 | A | 8/2004 |
| JP | 2007-505243 | A | 3/2007 |
| WO | WO-2005/026453 | A2 | 3/2005 |

* cited by examiner

EXCAVATING TOOTH AND BODY FOR EXCAVATING TOOTH

TECHNICAL FIELD

The present invention relates to an excavating tooth which serves as a ground engaging tool, and a body for the excavating tooth.

BACKGROUND ART

Conventionally, in a work machine such as a hydraulic excavator which performs earth excavation, excavating tooth members are detachably installed on tip ends of a bucket, for example. A cutting edge of the tooth member penetrates into an excavation subject such as ground or rocks during excavation. Due to the abrasion with the excavation subject in the penetration, the tooth member is abraded.

In order to prolong the operating life of the tooth member, there has been proposed an excavating tooth capable of inhibiting abrasion. For example, Japanese Patent Laying-Open No. 2004-92208 (PTD 1) discloses an excavating tooth capable of inhibiting abrasion by forming an abrasion-resistant layer on each central portion of a top face and a bottom face of the excavating tooth in the width direction.

CITATION LIST

Patent Document

PTD 1: Japanese Patent Laying-Open No. 2004-92208

SUMMARY OF INVENTION

Technical Problem

Since the excavating tooth on the whole shapes like a wedge, the cutting edge includes a linear section intersecting the excavation direction. The linear section serves as a "blade" to "cut" the excavation subject, and there occurs a penetration force. Although in the excavating tooth disclosed by PTD 1 the general amount of abrasion caused by the excavation operation is inhibited, both side portions of the blade edge are subjected to abrasion, and thereby, the length of the linear section of the cutting edge will become shorter. In other words, the shape of the cutting edge of the excavating tooth will become round as the excavation is progressed. As a result, despite the less amount of abrasion on the blade edge, the penetration force of the cutting edge into the excavation subject decreases.

The present invention has been accomplished in view of the aforementioned problems, and it is therefore an object of the present invention to provide an excavating tooth and a body for the excavating tooth capable of keeping a penetration force of a blade edge high in penetrating into an excavation subject.

Solution to Problem

One aspect of an excavating tooth of the present invention includes a body and an abrasion-resistant layer. The body has one end and the other end. The abrasion-resistant layer is formed on the body and has hardness higher than the body. The body includes a tip end face, a first face, a second face, a pair of first slope faces, and a pair of second slope faces. The tip end face is positioned at the one end. The first face and the second face extend respectively from the tip end face up to the other end and face each other. The pair of first slope faces extends respectively from the tip end face toward the other end and form an obtuse angle on the tip end face with the first face. The pair of second slope faces extends respectively from the tip end face toward the other end and form an obtuse angle on the tip end face with the second face. The abrasion-resistant layer includes a first abrasion-resistant layer section and a second abrasion-resistant layer section. The first abrasion-resistant layer section is formed on the tip end face. The second abrasion-resistant layer section is formed respectively on the pair of first slope faces and the pair of second slope faces.

According to one aspect of the excavating tooth of the present invention, the first abrasion-resistant layer section is formed on the tip end face, and the second abrasion-resistant layer section is formed on the first and second slope faces positioned at side portions of the tip end face. Thus, it is possible to inhibit the tip end and side portions of a blade edge from being abraded, which makes it possible to inhibit the cutting edge of the excavating tooth from becoming round or inhibit the width of the linear portion of the cutting edge from becoming narrower. Thereby, it is possible to keep a penetration force of the cutting edge high in penetrating into an excavation subject.

In the excavating tooth mentioned above, the tip end face has a hexagonal shape. Thereby, it is possible to reduce load acting on corners of the tip end face in comparison to the case where the tip end face has a tetragonal shape. Thus, it is possible to inhibit the corners of the tip end face from being abraded. In other words, it is possible to inhibit the tip end face from being abraded round.

In the excavating tooth mentioned above, the abrasion-resistant layer includes a third abrasion-resistant layer section formed on at least one of the first face and the second face. Thereby, it is possible to inhibit at least one of the first face and the second face from being abraded. As a result, it is possible to inhibit the general abrasion from progressing on the excavating tooth during an excavation operation.

In the excavating tooth mentioned above, the second abrasion-resistant layer section and the third abrasion-resistant layer section are formed to enclose the one end of the body. Thereby, it is possible to inhibit the surroundings of the body at the side of the cutting edge from being abraded. As a result, it is possible to inhibit the cutting edge of the excavating tooth from being abraded round. In other words, since the blade edge can be kept in the original shape, it is possible to inhibit the penetration force from decreasing.

Another aspect of an excavating tooth of the present invention includes a body and an abrasion-resistant layer. The body has one end, the other end opposite to the one end, and a hole formed in an end face of the other end. The abrasion-resistant layer is formed on the body and has hardness higher than the body. The tip end face is positioned at the one end. A first face and a second face extend respectively from the tip end face up to the other end and face each other. A pair of first slope faces extends respectively from the tip end face toward the other end and is connected respectively to both ends of a side of the first face bordering the tip end face so as to form an obtuse angle with the first face. A pair of second slope faces extends respectively from the tip end face toward the other end and is connected respectively to both ends of a side of the second face bordering the tip end face so as to form an obtuse angle with the second face. The pair of first slope faces and the pair of second slope faces are connected to each other on the tip end face. The abrasion-resistant layer includes a first abrasion-resistant layer section, a second abrasion-resistant layer section, and a third abrasion-resistant layer section. The first abrasion-resistant layer section is formed on the tip end face. The second abrasion-resistant layer section is formed respectively on the pair of first slope faces and the pair of second slope faces. The third abrasion-resistant layer section is formed on one end of each of the first face and the second face.

According to another aspect of the excavating tooth of the present invention, the first abrasion-resistant layer section is formed on the tip end face and the second abrasion-resistant layer section is formed on the first and second slope faces positioned at side portions of the tip end face. Thus, it is possible to inhibit the tip end and side portions of the cutting edge from being abraded. As a result, it is possible to inhibit the cutting edge from being abraded round. Thereby, it is possible to keep the penetration force of the cutting edge high in penetrating into an excavation subject. Further, since the third abrasion-resistant layer section is formed on each of the first face and the second face, it is possible to inhibit the first face and the second face from being abraded. Thereby, it is possible to inhibit the abrasion from progressing on the cutting edge of the excavating tooth. Furthermore, since the pair of first slope faces and the pair of second slope faces are connected to each other on the tip end face, the tip end face is formed to have a hexagonal shape. Thereby, it is possible to inhibit the corners of the tip end face from being abraded, which makes it possible to keep the tip end face in a shape similar to the original shape.

A body for an excavating tooth of the present invention includes one end and the other end, a flat tip end face, a first face, a second face, a pair of first flat slope faces, and a pair of second flat slope faces. The tip end face is positioned at the one end. The first face and the second face extend respectively from the tip end face up to the other end and face each other. The pair of first slope faces extends respectively from the tip end face toward the other end and form an obtuse angle on the tip end face with the first face. The pair of second slope faces extends respectively from the tip end face toward the other end and form an obtuse angle on the tip end face with the second face. The tip end face enclosed by the first face, the second face, the pair of first slope faces and the pair of second slope faces has a hexagonal shape.

According to the body for the excavating tooth of the present invention, since the tip end face and the first and second slope faces positioned at side portions of the tip end face are flat, it is easy to form an abrasion-resistant layer thereon, respectively. Owing to the abrasion-resistant layers, it is possible to inhibit the tip end and the side portions of the blade edge from being abraded. Thereby, it is possible to inhibit the cutting edge of the excavating tooth from being abraded round. Accordingly, it is possible to keep the penetration force of the cutting edge high in penetrating into an excavation subject. Moreover, since the tip end face has a hexagonal shape and further with the formation of the abrasion-resistant layers, it is possible to inhibit the corners of the tip end face from being abraded, which make it possible to keep the tip end face in a shape similar to the original shape.

Advantageous Effects of Invention

As mentioned above, according to the present invention, it is possible to keep the penetration force of the cutting edge high in penetrating into an excavation subject.

DESCRIPTION OF EMBODIMENTS

Hereinafter, embodiments of the present invention will be described with reference to the drawings.

First, a structure of a work machine according to an embodiment of the present invention will be described. In the following, the description will be made on a hydraulic excavator which serves as an example of the work machine to which the concept of the present invention is applicable; however, it should be noted that the present invention is applicable to any work machine equipped with an excavating tooth.

Figure 1:
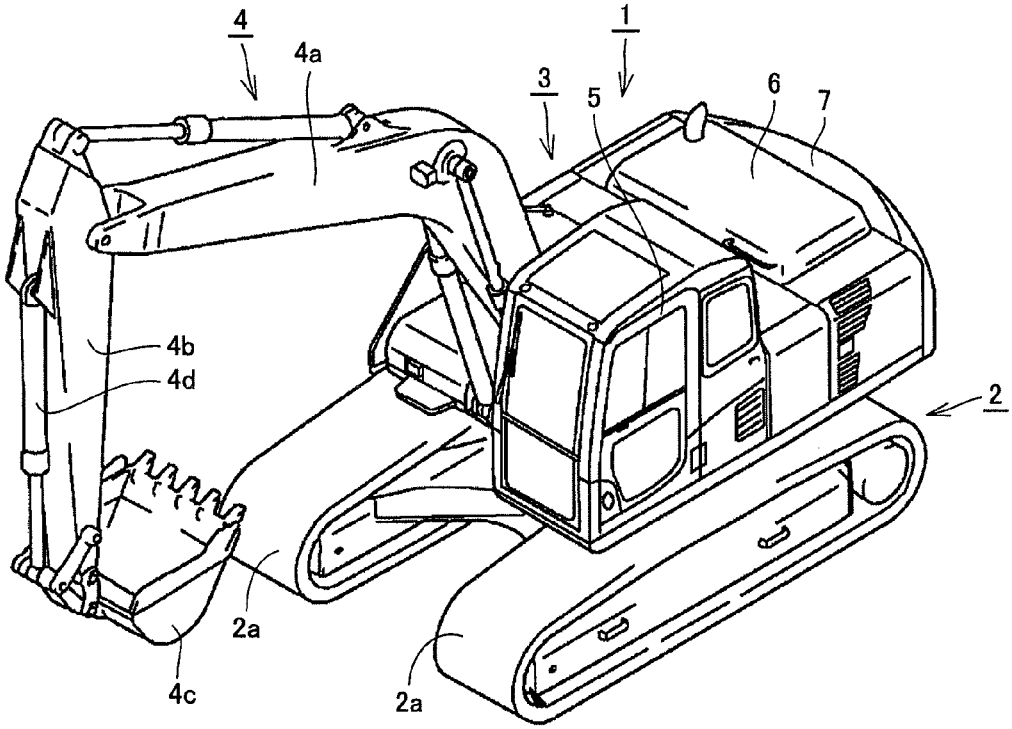
FIG. 1 is a perspective view schematically illustrating a structure of a hydraulic excavator according to an embodiment of the present invention.

With reference to FIG. 1, a hydraulic excavator 1 generally includes a lower traveling unit 2, an upper revolving unit 3, and a work implement 4. Lower traveling unit 2 is configured to move autonomously according to the rotation of a pair of lateral crawler belts 2*a*. Upper revolving unit 3 is disposed on lower traveling unit 2, capable of rotating freely. Work implement 4 is pivotally supported at the front side of upper revolving unit 3, capable of moving up and down freely. Work implement 4 includes a boom 4*a*, an arm 4*b*, a bucket 4*c*, hydraulic cylinders 4*d* and the like.

Generally, lower traveling unit 2 and upper revolving unit 3 constitute a main body of a work vehicle. Upper revolving unit 3 includes a cab 5 which is disposed at a front-left side (front side of the vehicle), an engine compartment 6 for housing therein an engine and a counter weight 7 which are disposed at a rear side (rear side of the vehicle). In the present embodiment, the front side, the rear side, the left side and the right side of the vehicle are defined relative to an operator seated in cab 5.

Figure 2:
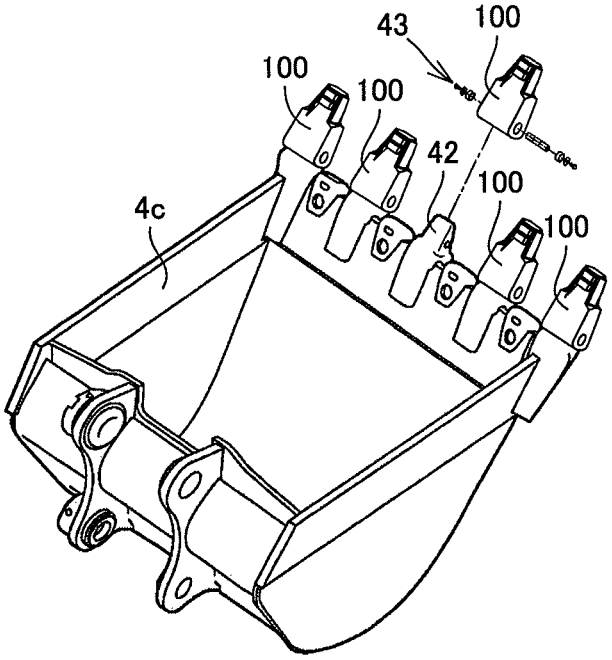
FIG. 2 is a perspective view schematically illustrating a structure of an excavating tooth to be mounted to a bucket according to an embodiment of the present invention.

Next, with reference to FIG. 2, a structure of an excavating tooth 100 to be mounted to bucket 4*c* will be described. One end of bucket 4*c* is disposed with a plurality of excavating teeth 100. Excavating teeth 100 are claw-shaped members mounted to a tip end of an excavation portion of bucket 4*c* so as to enable bucket 4*c*, which is installed at a tip end of arm 4*b* of work implement 4, to perform excavation.

Each of the plurality of excavating teeth 100 is mounted to an adaptor 42 of bucket 4*c* through a retaining pin assembly 43. Retaining pin assembly 43 is a member for retaining excavating tooth 100 to adaptor 42 without dropping out therefrom. Retaining pin assembly 43 includes a retaining pin unit, a bolt, a washer and a bushing. A through hole is formed in adaptor 42 in the width direction thereof, and retaining pin assembly 43 is inserted through the through hole and a through hole 17, which is disposed in excavating tooth 100 and will be described hereinafter, to retain excavating tooth 100 on adaptor 42.

Figure 3:
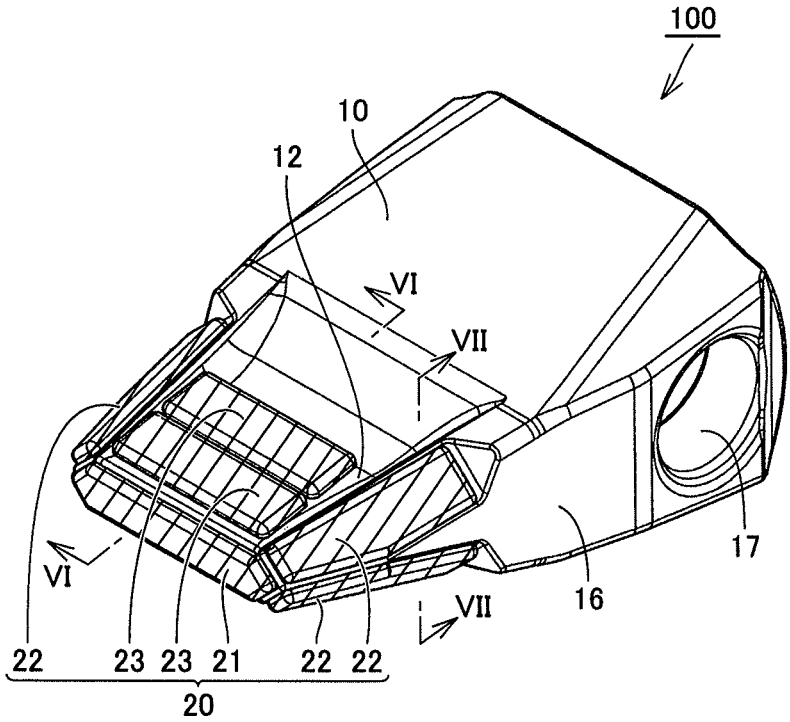
FIG. 3 is a perspective view schematically illustrating the structure of the excavating tooth according to an embodiment of the present invention when viewed from one end.
Figure 4:
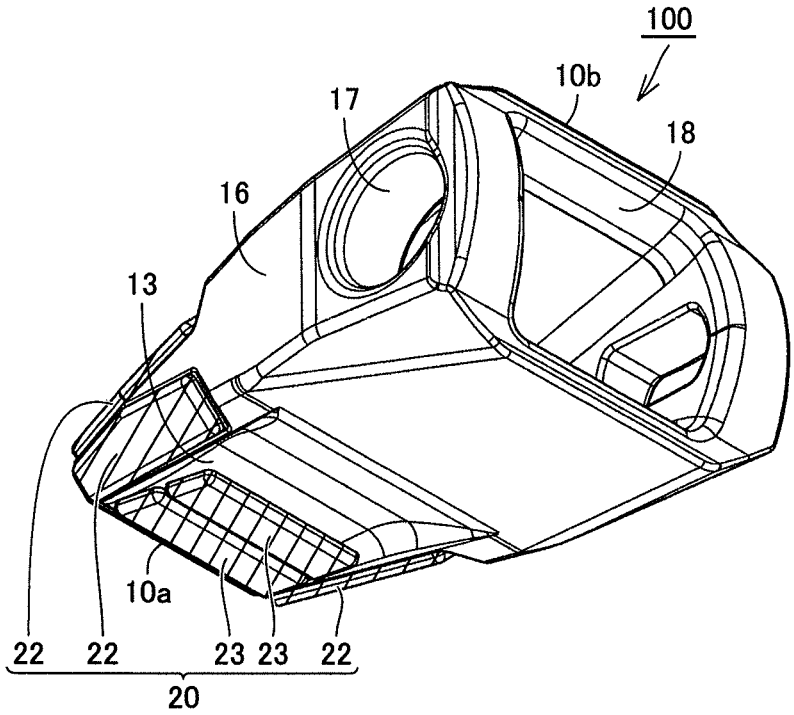
FIG. 4 is a perspective view schematically illustrating the structure of the excavating tooth according to an embodiment of the present invention when viewed from the other end.
Figure 5:
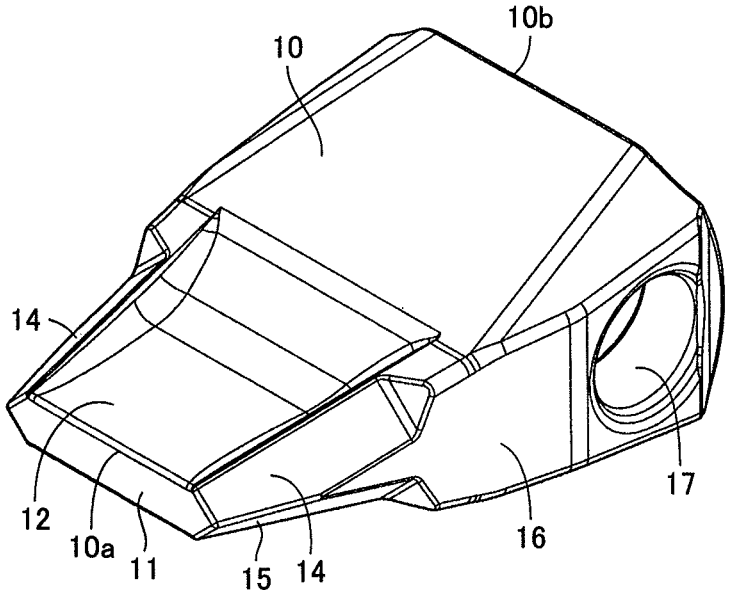
FIG. 5 is a perspective view schematically illustrating a structure of a body for an excavating tooth according to an embodiment of the present invention.

With reference to FIGS. 3 to 5, excavating tooth 100 mainly includes a body 10 and an abrasion-resistant layer 20. Body 10 has one end 10*a* and the other end 10*b*. One end 10*a* is disposed at the tip end side of excavating tooth 100, and the other end 10*b* is disposed at the base end side of excavating tooth 100. In other words, the other end 10*b* is opposite to one end 10*a*. Excavating tooth 100 has a shape of a wedge which becomes thinner toward the tip end thereof.

Body 10 includes a tip end face 11, a first face 12, a second face 13, a pair of first slope faces 14, a pair of second slope faces 15, a pair of side faces 16, a pair of through holes 17, and a hole 18. First slope faces 14, second slope faces 15 and side faces 16 form side portions of excavating tooth 100 or body 10.

As shown mainly in FIG. 5, tip end face 11 is positioned at one end 10*a*. Tip end face 11 has a flat surface. Tip end face 11 has a hexagonal shape. Tip end face 11 is enclosed by first face 12, second face 13, the pair of first slope faces 14 and the pair of second slope faces 15. The hexagonal shape is a flattened hexagon in which each side is a straight line, and the distance between a side bordering first face 12 and a side bordering second face 13 is narrower. The side bordering first face 12 and the side bordering second face 13 have the same length, and the other four sides bordering the first and second slope faces have an equal length which is shorter than the side bordering first face 12.

First face 12 and second face 13 extend respectively from tip end face 11 (one end 10*a*) up to the other end 10*b*. First face 12 and second face 13 face each other. The distance between first face 12 and second face 13 increases slightly from one end 10*a* toward the other end 10*b*. Each one end of first face 12 and second face 13 is formed into a flat surface.

The pair of first slope faces 14 extends respectively from tip end face 11 toward the other end 10*b*. The pair of first slope faces 14 is connected respectively to both ends of the side of the first face 12 bordering the tip end face 11 so as to form an obtuse angle with the first face 12. Each of the pair of first slope faces 14 is flat and has a pentangular shape close to a rectangle. The length from one end 10*a* of the pair of first slope faces 14 to the other end 10*b* thereof is about 40% of the length of excavating tooth 100.

The pair of second slope faces 15 is a flat surface symmetrical to the pair of first slope faces 14. The pair of second slope faces 15 extends respectively from tip end face 11 toward the other end 10*b*. The pair of second slope faces 15 is connected respectively to both ends of the side of the second face 13 bordering the tip end face 11 so as to form an obtuse angle with the second face 13. The pair of first slope faces 14 and the pair of second slope faces 15 are connected to each other at tip end face 11 and a region nearby tip end face 11. A portion of first slope face 14 and a portion of second slope face 15, which are not directly connected, are connected through the intermediary of a side face 16 to be described later.

As shown mainly in FIG. 4, side face 16 is formed on both sides of body 10, intersecting both first face 12 and second face 13. Side face 16 is substantially flat and has a part thereof disposed between first slope face 14 and second slope face 15. Through hole 17 is formed respectively on side faces 16 at both sides. Hole 18 is formed at an end face of the other end 10*b*. Hole 18 is formed in body 10 from the other end 10*b* toward one end 10*a*. Through hole 17 is formed in communication with hole 18. After adaptor 42 is inserted into hole 18, retaining pin assembly 43 is inserted into through hole 17 so as to retain excavating tooth 100 to bucket 4*c*.

As shown mainly in FIG. 3 and FIG. 4, abrasion-resistant layer 20 has hardness higher than body 10 and possesses abrasion resistance. As a material for body 10, for example, low-alloy steel (such as manganese steel or chromium molybdenum steel) which has a carbon content of 0.2 wt % to 0.4 wt % and is processed through quenching and tempering to have a hardness of HRC 45 to 50 is used. The hardness of abrasion-resistant layer 20 is dependent on hard particles 20*b* dispersed in the layer, and is about HRC 80 to 100.

Abrasion-resistant layer 20 includes a first abrasion-resistant layer section 21, a second abrasion-resistant layer section 22, and a third abrasion-resistant layer section 23. It is acceptable that abrasion-resistant layer 20 includes at least first abrasion-resistant layer section 21 and second abrasion-resistant layer section 22. Abrasion-resistant layer 20 is formed through overlay welding on body 10.

First abrasion-resistant layer section 21 is formed on tip end face 11. First abrasion-resistant layer section 21 is formed into a belt along tip end face 11, and thereby, first abrasion-resistant layer section 21 has a hexagonal shape matching with tip end face 11.

Second abrasion-resistant layer section 22 is formed respectively on the pair of first slope faces 14 and the pair of second slope faces 15. Each second abrasion-resistant layer section 22 is formed into a belt along each first slope face 14 and each second slope face 15. Each second abrasion-resistant layer section 22 is formed to reach the cutting edge. However, second abrasion-resistant layer section 22 may be formed as being separated from tip end face 11 by a distance of 1 mm to 3 mm; even in this case, second abrasion-resistant layer section 22 is still formed to reach the cutting edge.

The width of first abrasion-resistant layer section 21 in the direction where first face 12 faces second face 13 (in the shorter direction) and the width of second abrasion-resistant layer section 22 in the direction intersecting the extending direction from tip end face 11 toward the other end 10*b* (in the shorter direction) are in a size of 10 mm to 50 mm. Preferably, the widths are in a size of 15 mm to 35 mm.

Third abrasion-resistant layer section 23 is formed on each of first face 12 and second face 13. Third abrasion-resistant layer section 23 is formed in two parts on each of first face 12 and second face 13. Third abrasion-resistant layer section 23 is formed into a belt along one end 10*a* at portions of first face 12 and second face 13 nearby tip end face 11, respectively. Each third abrasion-resistant layer section 23 is formed to reach the blade edge. Third abrasion-resistant layer section 23 may be formed as being separated from tip end face 11 by a distance of 1 mm to 3 mm; however, even in this case, third abrasion-resistant layer section 23 is still formed to reach the cutting edge. In the present embodiment, third abrasion-resistant layer section 23 is formed on both first face 12 and second face 13; however, it is acceptable for it to be formed only on any one face. Alternatively, it is acceptable that third abrasion-resistant layer section 23 is not disposed.

In the present embodiment, the tip end face, each one end of the first and second faces, and the first and second slope faces are formed into a flat surface, but it is not necessary to be a completely flat surface geometrically. It is acceptable that these faces are formed flat to an extent without interfering with the formation of the abrasion-resistant layer which will be described later.

First abrasion-resistant layer section 21, second abrasion-resistant layer section 22 and third abrasion-resistant layer section 23 each have a thickness of 4 mm to 7 mm, for example.

In the present embodiment, second abrasion-resistant layer sections 22 and third abrasion-resistant layer sections 23 are formed to enclose one end 10*a* of body 10. Here, second abrasion-resistant layer sections 22 and third abrasion-resistant layer sections 23 being formed to enclose body 10 means that body 10 is substantially enclosed by second abrasion-resistant layer sections 22 and third abrasion-resistant layer sections 23, and a gap is allowed to be present between second abrasion-resistant layer section 22 and third abrasion-resistant layer section 23. The dimension of the gap may be, for example, from 1 mm to 3 mm. It has been described that second abrasion-resistant layer section 22 and third abrasion-resistant layer section 23 enclose body 10 discontinuously. If it is possible to weld second abrasion-resistant layer section 22 and third abrasion-resistant layer section 23 to the corners of body 10, second abrasion-resistant layer section 22 and third abrasion-resistant layer section 23 may be formed to enclose body 10 continuously.

Figure 6:
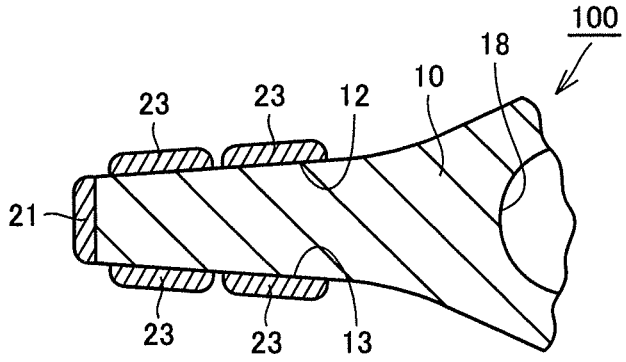
FIG. 6 is a schematic cross sectional view taken along a line VI-VI in FIG. 3.

Referring to FIGS. 3 and 6, a gap is allowed to be present between first abrasion-resistant layer section 21 and second abrasion-resistant layer section 22. Two second abrasion-resistant layer sections 22 may be formed on first face 12 with a gap formed therebetween. Similarly, two second abrasion-resistant layer sections 22 may be formed on second face 13 with a gap formed therebetween. Each of first to third abrasion-resistant layer sections 21 to 23 may be formed round at outer peripheral edges thereof.

Figure 7:
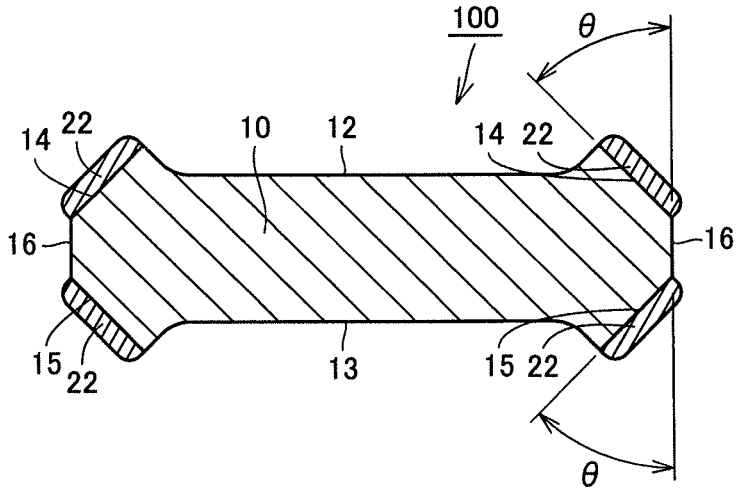
FIG. 7 is a schematic cross sectional view taken along a line VII-VII in FIG. 3.

Referring to FIGS. 3 and 7, first slope face 14 slopes at an angle θ relative to side face 16. Similarly, second slope face 15 slopes at the angle θ relative to side face 16. The angle θ may be, for example, 45 degrees. Each of second abrasion-resistant layer sections 22 is configured to extend outward relative to first face 12 and second face 13.

Figure 8:
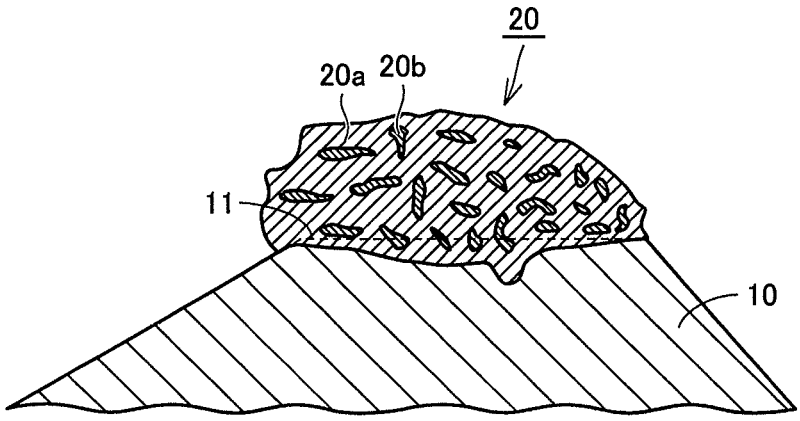
FIG. 8 is a cross sectional view schematically illustrating a structure of a joint portion between a body and an abrasion-resistant layer according to an embodiment of the present invention.

Hereinafter, referring to FIG. 8, the structure of a joint portion between body 10 and abrasion-resistant layer 20 will be described in detail. FIG. 8 illustrates a sample in which abrasion-resistant layer 20 is formed on tip end face 11 of body 10. Abrasion-resistant layer 20 contains a welding 20*a* and hard particles 20*b*. Hard particles 20*b* are distributed inside the entire welding material 20*a*.

Abrasion-resistant layer 20 is deposited through introducing hard particles 20*b* made of WC-7% Co particles having a grain size of 0.5 mm to 4 mm into a molten pool of welding material 20*a* generated by an arc electrode. As welding material 20*a*, for example, soft iron may be used. As hard particles 20*b*, any substance containing carbide as a major ingredient may be used. As examples of carbide, TiC, ZrC, HfC (Group IVB), VC, NbC, TaC (Group VB), Mo2C, W2C, WC (Group VIB) and the like may be given.

Tip end face 11 is firstly constructed into a flat surface (illustrated by a dashed line in FIG. 8). Abrasion-resistant layer 20 is formed through welding at tip end face 11 constructed by the flat surface. During the welding, tip end face 11 melts and intermingles with abrasion-resistant layer 20. Thereby, as illustrated in FIG. 8, after the formation of abrasion-resistant layer 20, tip end face 11 is formed into a concave shape recessed from abrasion-resistant layer 20.

In the above, the description has been made on the example in which excavating tooth 100 is applied to bucket 4*c* in the hydraulic excavator, but the present invention is not limited thereto.

Hereinafter, the description will be made on an example in which excavating tooth 100 is applied to a bucket mounted to a front portion of a work machine such as a bulldozer or a wheel loader.

Figure 9:
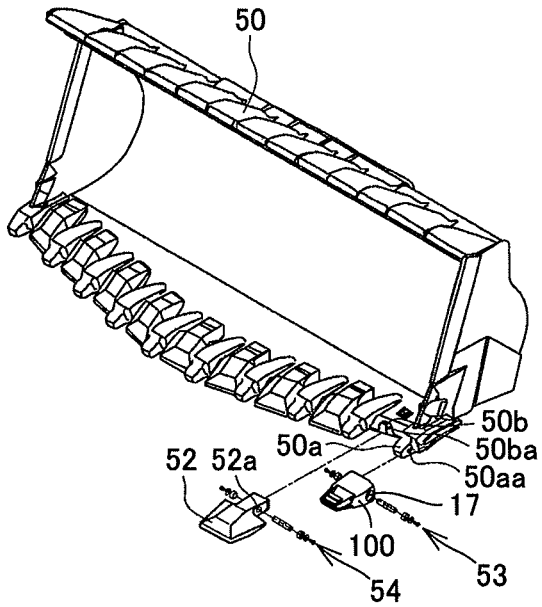
FIG. 9 is a perspective view schematically illustrating structures of excavating teeth and lip protectors between excavating teeth to be mounted to a bucket according to a modification of an embodiment of the present invention.

Referring to FIG. 9, a bucket 50 as a modification of an embodiment of the present invention is mounted with a plurality of excavating teeth 100 and a plurality of lip protectors between excavating teeth (protection member, ground engaging tool) 52 at a tip end of a ground engaging section. In FIG. 9, the other parts except for the exploded excavating tooth 100 are schematically simplified.

An insertion member 50*a* formed at the front end of bucket 50 is inserted inside excavating tooth 100. Thereafter, a retaining pin assembly 53 is inserted into through hole 17 of excavating tooth 100 and a through hole 50*aa* of insertion member 50*a* to hold excavating tooth 100 relative to insertion member 50*a*.

The lip protectors between excavating teeth 52 are disposed respectively between the plurality of excavating teeth 100 as a protection member to protect edge portions of bucket 50, and has a hollow portion (hole) inside, which is similar to excavating tooth 100 described above. An insertion member 50*b* formed at the front end of bucket 50 is inserted into the hollow portion inside lip protector between excavating teeth 52. Thereafter, a retaining pin assembly 54 is inserted into through hole 52*a* of lip protector between excavating teeth 52 and a through hole 50*ba* of insertion member 50*b* to hold lip protector between excavating teeth 52 relative to insertion member 50*b*. Retaining pin assemblies 53 and 54 have the same structure as retaining pin assembly 43 described in the above.

Hereinafter, the advantageous effects of an embodiment of the present invention will be described.

According to excavating tooth 100 of an embodiment of the present invention, first and second abrasion-resistant layer sections 21 and 22 are formed on tip end face 11, and first and second slope faces 14 and 15 positioned at side portions of tip end face 11. Thus, the tip end and the side portions of the cutting edge can be inhibited from being abraded. Thereby, it is possible to inhibit the cutting edge of excavating tooth 100 from being rounded or to inhibit the width of a linear portion of the cutting edge from becoming narrow. As a result, it is possible to keep the penetration force of the cutting edge high in penetrating into an excavation subject.

In the excavating tooth described above, tip end face 11 has a hexagonal shape. Thereby, it is possible to reduce the load acting on the corners of the side portions of tip end face 11 in comparison with the case where tip end face 11 has a tetragonal shape. Thus, it is possible to inhibit the corners of the tip end face from being abraded. As a result, it is possible to inhibit second abrasion-resistant layer section 22 from being stripped away from each of the pair of first slope faces 14 and the pair of second slope faces 15.

In excavating tooth 100 of an embodiment of the present invention, third abrasion-resistant layer section 23 is formed on at least one of first face 12 and second face 13. Thus, it is possible to inhibit at least one of first face 12 and second face 13 from being abraded. As a result, it is possible to inhibit the length from one end 10*a* to the other end 10*b* of excavation 100 from being shortened.

In excavating tooth 100 of an embodiment of the present invention, second abrasion-resistant layer section 22 and third abrasion-resistant layer section 23 are formed to enclose body 10. Thereby, it is possible to inhibit the periphery of body 10 from being abraded. As a result, it is possible to inhibit the width and the thickness of the blade edge of excavating tooth 100 from becoming narrow.

In excavating tooth 100 of an embodiment of the present invention, since third abrasion-resistant layer section 23 is formed on each of first and second faces 12 and 13, it is possible to inhibit first face 12 and second face 13 from being abraded. Thereby, it is possible to inhibit the thickness of the blade edge of excavating tooth 100 from becoming narrow. Moreover, since the pair of first slope faces 14 and the pair of second slope faces 15 are connected to each other at tip end face 11, the tip end face has a hexagonal shape. As a result, it is possible to inhibit second abrasion-resistant layer section 22 from being stripped away from each of the pair of first slope faces 14 and the pair of second slope faces 15.

According to body 10 for the excavating tooth of an embodiment of the present invention, since abrasion-resistant layer 20 can be formed on tip end face 11 and first and second slope faces 14 and 15 positioned at side portions of tip end face 11, the formation of abrasion-resistant layer 20 can inhibit the tip end of the cutting edge and the side portions thereof from being abraded. Thereby, it is possible to inhibit the cutting edge of excavating tooth 100 from being rounded or to inhibit the width of a linear portion of the cutting edge from becoming narrow. As a result, it is possible to keep the penetration force of the cutting edge high in penetrating into an excavation subject. Moreover, since tip end face 11 has a hexagonal shape, it is possible to inhibit abrasion-resistant layer 20 from being stripped away from the pair of first slope faces 14 and the pair of second slope faces 15.

It should be understood that the embodiments disclosed herein have been presented for the purpose of illustration and description but not limited in all aspects. It is intended that the scope of the present invention is not limited to the description above but defined by the scope of the claims and encompasses all modifications equivalent in meaning and scope to the claims.

INDUSTRIAL APPLICABILITY

The present invention is advantageously applicable to especially an excavation tooth and a body thereof used in a work machine.

REFERENCE SIGNS LIST

1: hydraulic excavator; 2: lower traveling unit; 2*a*: crawler belt; 3: upper revolving unit; 4: work implement; 4*a*: boom; 4*b*: arm; 4*c*, 50: bucket; 4*d*: hydraulic cylinder; 5: cab; 6: engine compartment; 7: counter weight; 10: body; 10*a*: one end; 10*b*: the other end; 11: tip end face; 12: first face; 13: second face; 14: first slope face; 15: second slope face; 16: side face; 17, 32*a*, 32*c*, 33*a*, 50*aa*, 50*ba*, 52*a*: through hole; 18: hole; 20: abrasion-resistant layer; 20*a*: welding material; 20*b*: hard particle; 21: first abrasion-resistant layer section; 22: second abrasion-resistant layer section; 23: third abrasion-resistant layer section; 43, 53: retaining pin assembly; 42: adaptor; 43: pin assembly; 50*a*, 50*b*: insertion member; 52: lip protector between excavating teeth; 100: excavating tooth

The invention claimed is:

1. An excavating tooth comprising:

a body having a distal end and a proximal end; and an abrasion-resistant layer formed on said body and having hardness higher than said body, said body including a tip end face positioned at said distal end, a first face and a second face extending respectively from said tip end face up to said proximal end and facing each other, a pair of first slope faces extending respectively from said tip end face toward said proximal end and forming an obtuse angle on said tip end face with said first face, and a pair of second slope faces extending respectively from said tip end face toward said proximal end and forming an obtuse angle on said tip end face with said second face, said abrasion-resistant layer including a first abrasion-resistant layer section formed on said tip end face, and a second abrasion-resistant layer section formed respectively on said pair of first slope faces and said pair of second slope faces.

2. The excavating tooth according to claim 1, wherein said tip end face has a hexagonal shape.

3. The excavating tooth according to claim 1, wherein said abrasion-resistant layer includes a third abrasion-resistant layer section formed on at least one of said first face and said second face.

4. The excavating tooth according to claim 3, wherein said second abrasion-resistant layer section and said third abrasion-resistant layer section are formed to enclose said distal end of said body.

5. An excavating tooth comprising:

a body having a distal end, a proximal end opposite to said distal end, and a hole formed in an end face of said proximal end; and an abrasion-resistant layer formed on said body and having hardness higher than said body, said body including a tip end face positioned at said distal end, a first face and a second face extending respectively from said tip end face up to said proximal end and facing each other, a pair of first slope faces extending respectively from said tip end face toward said proximal end and being connected respectively to both ends of a side of said first face bordering said tip end face so as to form an obtuse angle with said first face, and a pair of second slope faces extending respectively from said tip end face toward said proximal end and being connected respectively to both ends of a side of said second face bordering said tip end face so as to form an obtuse angle with said second face, said pair of first slope faces and said pair of second slope faces being connected to each other on said tip end face, said abrasion-resistant layer including a first abrasion-resistant layer section formed on said tip end face, a second abrasion-resistant layer section formed respectively on said pair of first slope faces and said pair of second slope faces, and a third abrasion-resistant layer section formed on a distal end of each of said first face and said second face.

6. A body for an excavating tooth having a distal end and a proximal end, comprising:

a flat tip end face positioned at said distal end;

a first face and a second face extending respectively from said tip end face up to said proximal end and facing each other;

a pair of first flat slope faces extending respectively from said tip end face toward said proximal end and forming an obtuse angle on said tip end face with said first face; and a pair of second flat slope faces extending respectively from said tip end face toward said proximal end and forming an obtuse angle on said tip end face with said second face, said tip end face enclosed by said first face, said second face, said pair of first slope faces and said pair of second slope faces having a hexagonal shape, said pair of first slope faces and said pair of second slope faces being connected to each other at said tip end face and a region nearby said tip end face, a portion of said first slope face and a portion of said second slope face, which are not directly connected, being connected through the intermediary of a side face which is a flat surface.

* * * * *